US010874913B2

(12) United States Patent
Koide et al.

(10) Patent No.: US 10,874,913 B2
(45) Date of Patent: Dec. 29, 2020

(54) LIQUID DISCHARGE HEAD AND LIQUID DISCHARGE APPARATUS PROVIDED WITH THE SAME

(71) Applicant: Brother Kogyo Kabushiki Kaisha, Nagoya (JP)

(72) Inventors: Shohei Koide, Nagoya (JP); Keita Hirai, Nagoya (JP); Keita Sugiura, Toyokawa (JP); Hiroshi Katayama, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/712,518

(22) Filed: Dec. 12, 2019

(65) Prior Publication Data

US 2020/0238686 A1 Jul. 30, 2020

(30) Foreign Application Priority Data

Jan. 28, 2019 (JP) ..... 2019-012121

(51) Int. Cl.

| | |
|---|---|
| ***B41J 2/045*** | (2006.01) |
| ***B41J 2/14*** | (2006.01) |
| ***A63B 43/00*** | (2006.01) |
| ***A63B 37/00*** | (2006.01) |

(Continued)

(52) U.S. Cl.

CPC ..... *A63B 43/00* (2013.01); *A63B 24/0021* (2013.01); *A63B 37/0003* (2013.01); *A63B 71/0622* (2013.01); *A63B 2024/0034* (2013.01); *A63B 2071/0625* (2013.01); *A63B 2071/0694* (2013.01); *A63B 2220/35* (2013.01);

(Continued)

(58) Field of Classification Search

CPC ..... B41J 2/14201; B41J 2/18; B41J 2/04581; B41J 2002/14306

See application file for complete search history.

(56) References Cited

U.S. PATENT DOCUMENTS

2018/0201019 A1 7/2018 Seto et al.
2020/0198348 A1* 6/2020 Tamai ..... B41J 2/14233

FOREIGN PATENT DOCUMENTS

JP 2018-114675 A 7/2018
JP 2018-114713 A 7/2018

* cited by examiner

*Primary Examiner* — Julian D Huffman
(74) *Attorney, Agent, or Firm* — Banner & Witcoff, Ltd.

(57) ABSTRACT

A liquid discharge head includes: an individual channel having an inlet and an outlet, the individual channel including: a nozzle, an upstream-side pressure chamber arranged between the inlet and the nozzle, a downstream-side pressure chamber arranged between the outlet and the nozzle, an upstream-side throttle channel connecting the inlet and the upstream-side pressure chamber, and a downstream-side throttle channel connecting the outlet and the downstream-side pressure chamber; a supply channel connected to the inlet and configured to supply liquid to the individual channel; a recovery channel connected to the outlet and configured to recover the liquid from the individual channel; an upstream-side actuator configured to apply pressure to the liquid inside the upstream-side pressure chamber; and a downstream-side actuator configured to apply the pressure to the liquid inside the downstream-side pressure chamber. The channel resistance of the downstream-side throttle channel is smaller than that of the upstream-side throttle channel.

18 Claims, 9 Drawing Sheets

(51) Int. Cl.
*A63B 71/06* (2006.01)
*A63B 24/00* (2006.01)

(52) U.S. Cl.
CPC ..... *A63B 2220/40* (2013.01); *A63B 2220/833* (2013.01); *A63B 2225/52* (2013.01)

LIQUID DISCHARGE HEAD AND LIQUID DISCHARGE APPARATUS PROVIDED WITH THE SAME

CROSS REFERENCE TO RELATED APPLICATION

The present application claims priority from Japanese Patent Application No. 2019-012121 filed on Jan. 28, 2019, the disclosure of which is incorporated herein by reference in its entirety.

BACKGROUND

Field of the Invention

The present disclosure relates to a liquid discharge head and a liquid discharge apparatus provided with the same.

Description of the Related Art

Conventionally, there is a known liquid discharge head provided with a plurality of channels (individual channels) each of which includes: a nozzle, a first pressure chamber (upstream-side pressure chamber) and a second pressure chamber (downstream-side pressure chamber) connected to the nozzle, an auxiliary channel (upstream-side throttle channel) connected to the first pressure chamber, and an auxiliary channel (downstream-side throttle channel) connected to the second pressure chamber; a supply channel which supplies an ink to the plurality of individual channels; and a recovery channel which recovers the ink from the plurality of individual channels. In this liquid discharge head, a first piezoelectric element (upstream-side actuator) which applies pressure to the ink inside the first pressure chamber and a second piezoelectric element (downstream-side actuator) which applies pressure to the ink inside the second pressure chamber are driven to thereby cause the ink to be discharged (jetted) from the nozzle. Further, in this liquid discharge head, the ink is allowed to flow from the supply channel toward the recovery channel while passing through the individual channels. Furthermore, the volume of the second pressure chamber is made small as compared with the volume of the first pressure chamber.

SUMMARY

In a case that the upstream-side and downstream-side actuators are driven so as to cause the liquid to be discharged from the nozzle, the outflow of the liquid from each of the upstream-side and downstream-side pressure chambers toward the nozzle, the supply of the liquid to the upstream-side pressure chamber from the supply channel via the upstream-side throttle channel, and the supply of the liquid to the downstream-side pressure chamber from the recovery channel via the downstream-side throttle channel are performed. In this situation, in a case that the liquid is allowed to flow from the supply channel toward the recovery channel while passing through the individual channels, there is hardly caused any shortage in the supply of the liquid from the supply channel toward the upstream-side pressure chamber which is performed in a direction same as the above-described flow of the liquid. On the other hand, there is easily caused any shortage in the supply of the liquid from the recovery channel toward the downstream-side pressure chamber which is performed in a direction reverse to the above-described flow of the liquid. As a result, there arises any difference between a supply amount of the liquid to the upstream-side pressure chamber and a supply amount of the liquid to the downstream-side pressure chamber, thereby causing any unevenness in a discharge amount of the liquid discharged from the nozzle, which in turn leads to such a fear that the liquid might not be stably discharged from the nozzle.

In view of the above-described situation, an object of the present disclosure is to provide a liquid discharge head, and a liquid discharge apparatus provided with the same, which are capable of discharging the liquid stably from the nozzle.

According to a first aspect of the present disclosure, there is provided a liquid discharge head including: an individual channel having an inlet and an outlet, the individual channel including: a nozzle, an upstream-side pressure chamber arranged between the inlet and the nozzle, a downstream-side pressure chamber arranged between the outlet and the nozzle, an upstream-side throttle channel connecting the inlet and the upstream-side pressure chamber, and a downstream-side throttle channel connecting the outlet and the downstream-side pressure chamber; a supply channel connected to the inlet of the individual channel and configured to supply liquid to the individual channel; a recovery channel connected to the outlet of the individual channel and configured to recover the liquid from the individual channel; an upstream-side actuator configured to apply pressure to the liquid inside the upstream-side pressure chamber; and a downstream-side actuator configured to apply the pressure to the liquid inside the downstream-side pressure chamber, wherein a channel resistance of the downstream-side throttle channel is smaller than a channel resistance of the upstream-side throttle channel, and a volume of the upstream-side pressure chamber and a volume of the downstream-side pressure chamber are same as each other.

Further, according to a second aspect of the present disclosure, there is provided a liquid discharge head including: an individual channel having an inlet and an outlet, the individual channel including: a nozzle, an upstream-side pressure chamber arranged between the inlet and the nozzle, a downstream-side pressure chamber arranged between the outlet and the nozzle, an upstream-side throttle channel connecting the inlet and the upstream-side pressure chamber, and a downstream-side throttle channel connecting the outlet and the downstream-side pressure chamber; a supply channel connected to the inlet of the individual channel and configured to supply liquid to the individual channel; a recovery channel connected to the outlet of the individual channel and configured to recover the liquid from the individual channel; an upstream-side actuator configured to apply pressure to the liquid inside the upstream-side pressure chamber; and a downstream-side actuator configured to apply the pressure to the liquid inside the downstream-side pressure chamber, wherein a channel resistance of the downstream-side throttle channel is smaller than a channel resistance of the upstream-side throttle channel, and a channel resistance of the upstream-side pressure chamber is smaller than a channel resistance of the downstream-side pressure chamber.

BRIEF DESCRIPTION OF THE DRAWINGS

FIGS. 5A to 5D are views each depicting a driving pulse signal in the first embodiment, wherein FIG. 5A is a view depicting a driving pulse signal Pa applied to an upstream-side actuator; FIG. 5B depicts a driving pulse signal Pb applied to a downstream-side actuator; FIG. 5C is a view depicting the driving pulse signal Pa and the driving pulse signal Pb in a case that a driving timing of the upstream-side actuator and a driving timing of the downstream-side actuator are same; and FIG. 5D is a view depicting the driving pulse signal Pa and the driving pulse signal Pb in a case that the driving timing of the downstream-side actuator is delayed from the driving timing of the upstream-side actuator.

DESCRIPTION OF THE EMBODIMENTS

First Embodiment

In the following, a first embodiment of the present disclosure will be explained.

Figure 1:
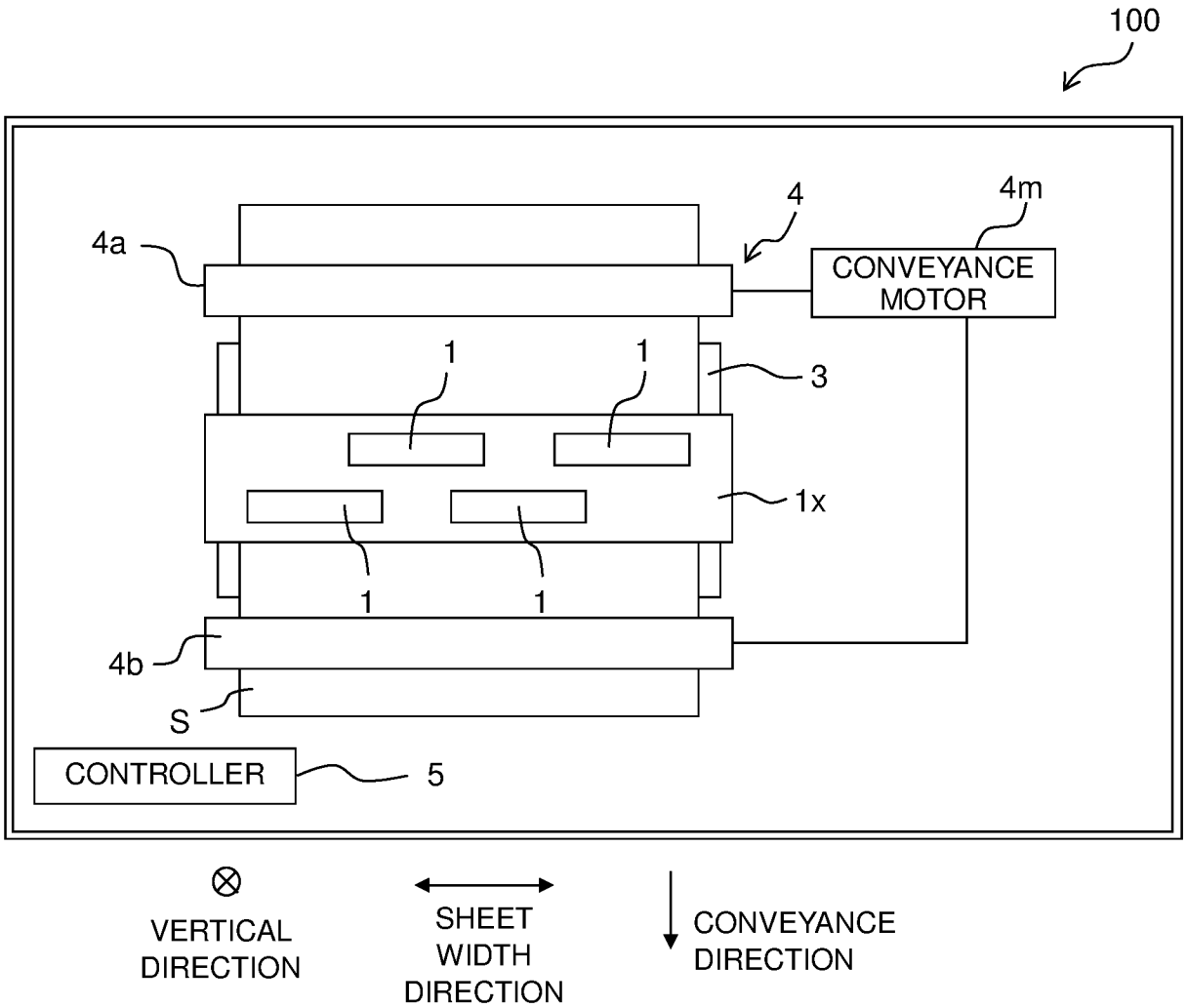
FIG. 1 is a plan view depicting a printer provided with a head according to a first embodiment of the present disclosure.

As depicted in FIG. 1, a printer 100 (corresponding to a "liquid discharge apparatus") according to the first embodiment is provided with a head unit 1X, a platen 3, a conveying mechanism 4, a controller 5, etc.

The conveying mechanism 4 has two conveying rollers 4*a* and 4*b* arranged side by side in a conveyance direction. The two conveying rollers 4*a* and 4*b* are connected to a conveyance motor 4*m* via a non-depicted gear, etc. In a case that the conveyance motor 4*m* is driven by the controller 5, the conveying rollers 4*a* and 4*b* are rotated to thereby convey a paper sheet (sheet) S as a recording medium in the conveyance direction.

The platen 3 is arranged while being sandwiched, in the conveyance direction, by the two conveying rollers 4*a* and 4*b*. The plate 3 supports the paper sheet S which is (being) conveyed by the conveying mechanism 4 from therebelow. The paper sheet S passes on the platen 3 by being conveyed by the conveying mechanism 4.

The head unit 1X is arranged to face or to be opposite to the platen 3 in a vertical direction (up-down direction), and is elongated in a sheet width direction. The head unit 1X is provided with four heads 1 (each corresponding to a "liquid discharge head") which are arranged in a staggered manner in the sheet width direction. Each of the heads 1 is driven by a driver IC 1*d* (see FIG. 4), and discharges or jets an ink from a plurality of nozzles 21 formed in a lower surface thereof (see FIGS. 2 and 3). Note that the sheet width direction is orthogonal to the conveyance direction. The sheet width direction and the conveyance direction are both orthogonal to the vertical direction (up-down direction). Further, in the vertical direction (up-down direction), a direction from the head unit 1 toward the platen 3 is referred to as "downward (down direction)", a direction opposite to the "downward" is referred to as "upward (up direction)", and a direction perpendicular to the vertical direction (up-down direction) is referred to as a "horizontal direction", as appropriate. The head 1 will be explained in detail later on.

In the printer 100, an image is recorded on the paper sheet S by causing the ink to be discharged from the plurality of nozzles 21 of each of the four heads 1, while conveying the paper sheet S in the conveyance direction by the conveying mechanism 4. Namely, the printer 100 is an ink-jet printer of a so-called line system wherein the ink is discharged from the nozzles 21 of the heads 1 in a state that the heads 1 are fixed.

Figure 4:
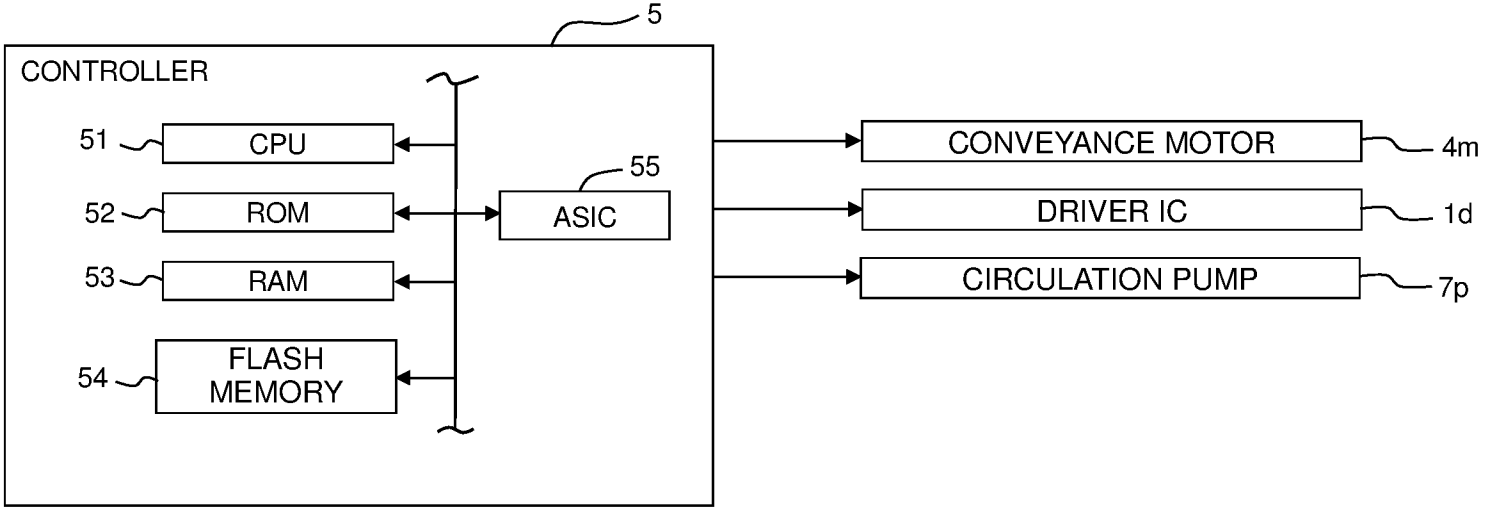
FIG. 4 is a block diagram depicting the electric configuration of the printer.

As depicted in FIG. 4, the controller 5 is constructed of a CPU (Central Processing Unit) 51, a ROM (Read Only Memory) 52, a RAM (Random Access Memory) 53, a flash memory 54, an ASIC (Application Specific Integrated Circuit) 55, etc., and controls the operations of the conveyance motor 4*m*, the driver IC 1*d*, a circulation pump 7*p*, etc. For example, the controller 5 controls the driver IC 1*d* of each of the heads 1 and the conveyance motor 4*m* based on a recording instruction (including image data) inputted from an external apparatus or device such as a PC, etc., to thereby execute a recording processing of recording an image on the paper sheet S.

Next, the configuration of each of the heads 1 will be explained in detail, with reference to FIGS. 2 and 3.

Each of the heads 1 has a channel substrate 11 and an actuator unit 12.

Figure 3:
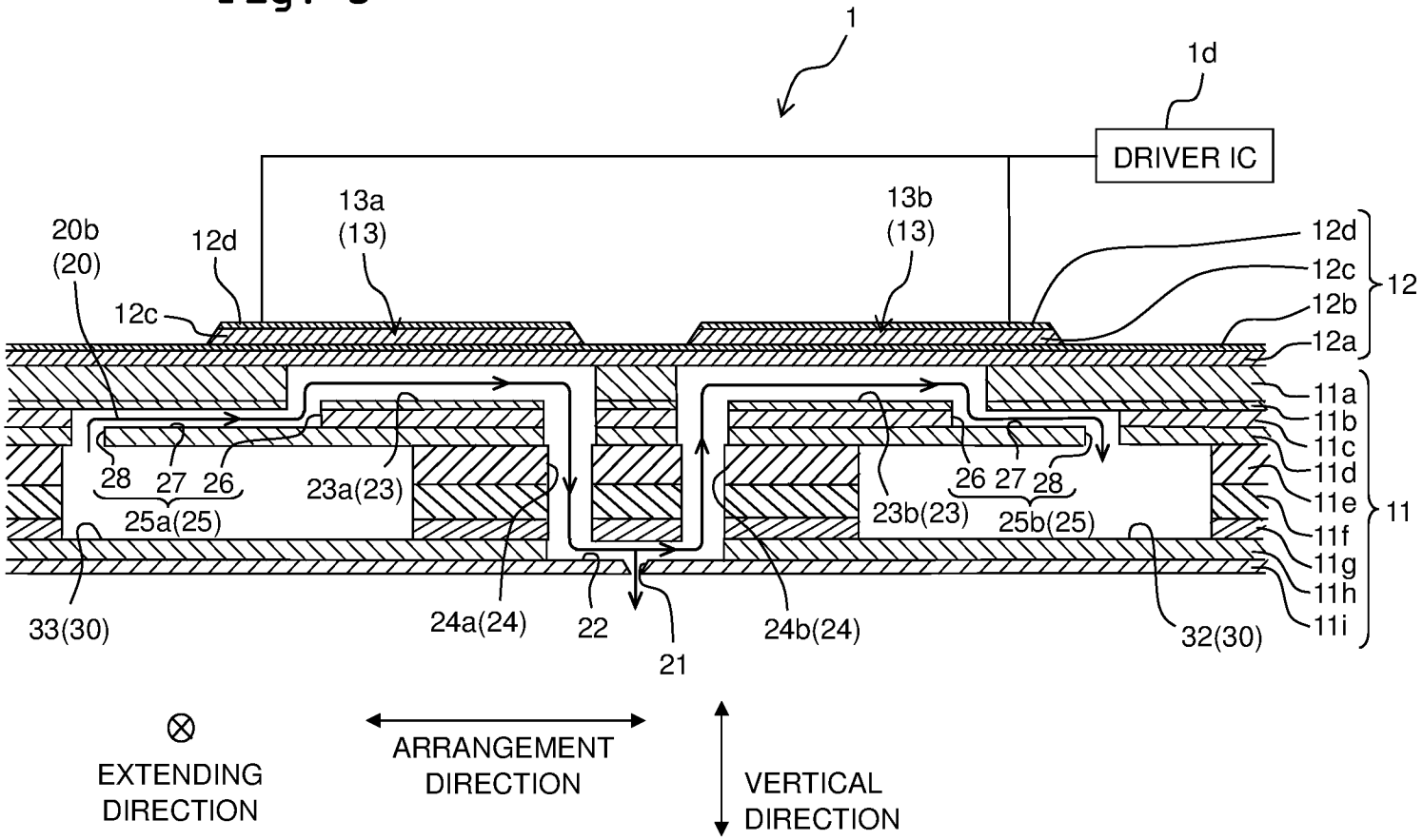
FIG. 3 is a cross-sectional view of the head, as taken along a line in FIG. 2.

As depicted in FIG. 3, the channel substrate 11 is formed by stacking nine plates 11*a* to 11*i* in this order from above. A common channel 30 is formed in the plates 11*e* to 11*g*. Further, a plurality of individual channels 20 communicating with the common channel 30 are formed in the plates 11*a* to 11*i*. The common channel 30 and the plurality of individual channels 20 are formed by performing etching for the channel substrate 11.

Figure 2:
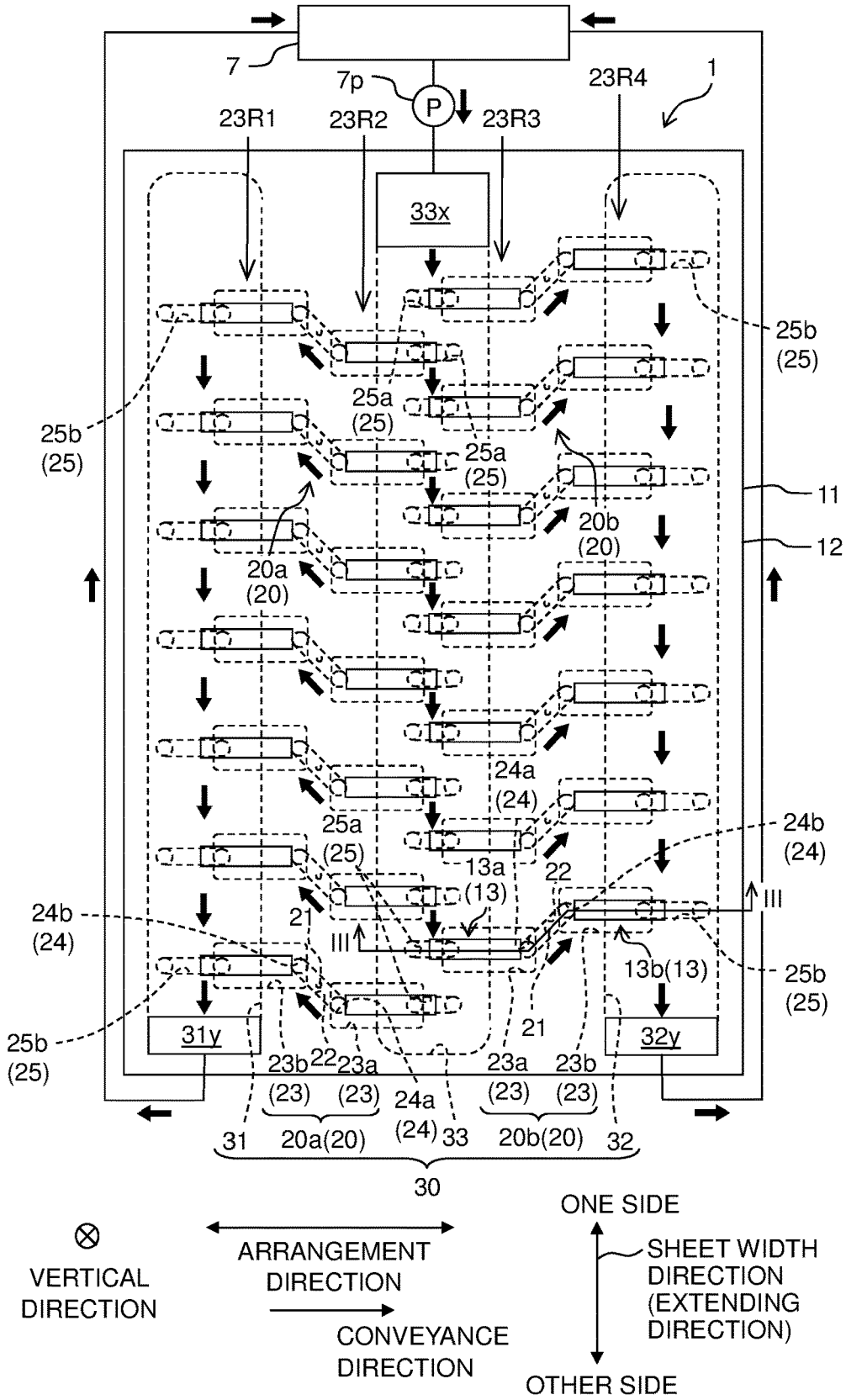
FIG. 2 is a plan view of the head depicted in FIG. 1.

As depicted in FIG. 2, the common channel 30 includes recovery channels 31 and 32 and a supply channel 33 arranged side by side in an arrangement direction (a direction parallel to the conveyance direction). The recovery channels 31 and 32 and the supply channel 33 each extend in an extending direction (a direction parallel to the sheet width direction). In the arrangement direction, the supply channel 33 is arranged between the recovery channels 31 and 32.

The supply channel 33 extends in an up-down direction at an end part, of the supply channel 33, on one side in the extending direction (an upper part in the sheet surface of FIG. 2) across the plates 11*a* to 11*g*; an inlet 33*x* is provided on an upper end part of the one end part. The inflow port 33*x* is connected to an ink tank 7 via the circulation pump 7*p*. Each of the recovery channels 31 and 32 extends in the up-down direction an end part, of each of the recovery channels 31 and 32, on the other side in the extending direction (a lower part in the sheet surface of FIG. 2) across the plates 11*a* to 11*g*; outflow ports 31*y* and 32*y* are provided on upper end parts of the end parts of the recovery channels 31 and 32, respectively. The outflow ports 31*y* and 32*y* are connected to the ink tank 7.

The ink tank 7 is connected to a non-depicted ink cartridge via a non-depicted tube, etc., and the ink is supplied from the ink cartridge to the ink tank 7.

The plurality of individual channels 20 include a plurality of first individual channels 20*a* each connecting the recovery channel 31 and the supply channel 33, and a plurality of second individual channels 20*b* each connecting the recovery channel 32 and the supply channel 33. Each of the plurality of first individual channels 20*a* straddles over the recovery channel 31 and the supply channel 33 in the arrangement direction. Each of the plurality of second individual channels 20*b* straddles over the recovery channel 32 and the supply channel 33 in the arrangement direction.

Each of the plurality of individual channels 20 includes a nozzle 21, a communicating path 22, an upstream-side pressure chamber 23*a*, a downstream-side pressure chamber 23*b*, an upstream-side descender channel 24*a*, a downstream-side descender channel 24*b*, an upstream-side throttle channel 25*a* and a downstream-side throttle channel 25*b*. As depicted in FIG. 3, each of the plurality of nozzles 21 is a through hole formed in the plate 11*i*. The communicating channel 22 is a channel passing immediately above the nozzle 21, and is formed in the plate 11*h*. Further, the communicating path 22 extends along the arrangement direction. The nozzle 21 is connected to a central part in the communicating path 22. Since the communicating path 22 is the channel passing immediately above the nozzle 21, the flow of the ink inside the communicating path 22 influences a discharge direction (flying direction) of the ink discharged from the nozzle 21.

The upstream-side pressure chamber 23*a* is arranged between the communicating path 22 and the supply channel 33. The downstream-side pressure chamber 23*b* is arranged between the communicating path 22 and one of the recovery channels 31 and 32. In the following, in a case of explaining the upstream-side pressure chamber 23*a* and the downstream-side pressure chamber 23*b* without discriminating these pressure chambers 23*a* and 23*b*, the upstream-side pressure chamber 23*a* and the downstream-side pressure chamber 23*b* are referred to as "pressure chamber(s) 23".

Each of the pressure chambers 23 is a through hole formed in the plate 11*a*. Each of the pressure chambers 23 has a planar shape which is substantially rectangular with the arrangement direction as a longitudinal direction thereof. Namely, the pressure chambers 23 extend along a plane parallel to the arrangement direction and the extending direction. Further, four pressure chamber rows 23R1 to 23R4 are formed in the plate 11*a*. The four pressure chamber rows 23R1 to 23R4 each extend in the extending direction, and are arranged side by side in the arrangement direction. Among the four pressure chamber rows 23R1 to 23R4, the pressure chamber rows 23R1 and 23R2 which are two left-side pressure chamber rows in FIG. 2 are constructed of the upstream-side pressure chambers 23*a* and the downstream-side pressure chambers 23*b* of the first individual channels 20*a*. Among the four pressure chamber rows 23R1 to 23R4, the pressure chamber rows 23R3 and 23R4 which are two right-side pressure chamber rows in FIG. 2 are constructed of the upstream-side pressure chambers 23*a* and the downstream-side pressure chambers 23*b* of the second individual channels 20*b*. In each of the pressure chamber rows 23R1 to 23R4, the pressure chambers 23 are arranged at a same position in the arrangement direction, and are arranged at an equal spacing distance therebetween in the extending direction. On the other hand, among the pressure chamber rows 23R1 to 23R4, the positions in the extending direction of the pressure chambers 23 are shifted from one another. With this, in all the pressure chambers 23, the position in the extending direction of a certain pressure chamber 23 is different from those of all remaining pressure chambers 23 different from the certain pressure chamber 23.

Note that in the present embodiment, the shapes of the pressure chambers 23 are all the same. Accordingly, the volumes of the pressure chambers 23 are also all the same.

The upstream-side descender channel 24*a* connects the upstream-side pressure chamber 23*a* and one end part of the communicating path 22. The downstream-side descender channel 24*b* connects the downstream-side pressure chamber 23*b* and the other end part of the communicating path 22. In the following, in a case of explaining the upstream-side descender channel 24*a* and the downstream-side descender channel 24*b* without discriminating these descender channels 24*a* and 24*b*, the upstream-side descender channel 24*a* and the downstream-side descender channel 24*b* are referred to as "descender channel(s) 24".

Each of the descender channels 24 is formed by through holes formed in the plates 11*b* to 11*g* and overlapped in the vertical direction. More specifically, the upstream-side descender 24*a* extends downward from a connection part thereof with respect to the upstream-side pressure chamber 23*a*. Further, the downstream-side descender 24*b* extends downward from a connection part thereof with respect to the downstream-side pressure chamber 23*b*.

The upstream-side descender channel 24*a* and the downstream-side descender channel 24*b* have lengths of channel (channel lengths) which are same as each other. Note that, as described above, the nozzle 21 is connected to the central part of the communicating path 22. Accordingly, a length of a channel (corresponding to an "upstream-side connecting channel") from the upstream-side pressure chamber 23*a* up to the nozzle 21 via the upstream-side descender channel 24*a* and a part of the communicating path 22 and a length of a channel (corresponding to an "downstream-side connecting channel") from the downstream-side pressure chamber 23*b* up to the nozzle 21 via the downstream-side descender channel 24*b* and a part of the communicating path 22 are substantially same.

The upstream-side throttle channel 25*a* connects the supply channel 33 and the upstream-side pressure chamber 23*a*. The downstream-side throttle channel 25*b* connects one of the recovery channels 31 and 32 and the downstream-side pressure chamber 23*b*. In the following, in a case of explaining the upstream-side throttle channel 25*a* and the downstream-side throttle channel 25*b* without discriminating these throttle channels 25*a* and 25*b*, the upstream-side throttle channel 25*a* and the downstream-side throttle channel 25*b* are referred to as "throttle channel(s) 25".

Each of the throttle channels 25 is formed to have a channel cross sectional area which is made smaller than a channel cross sectional area of other channels such as the pressure chamber 23, etc., to thereby have a throttling function of making a pressure wave generated in the pressure chamber 23 to hardly propagate to the supply channel 33, the recovery channels 31 and 32, etc. The throttle channel 25 is formed through the plates 11*b* to 11*d*. More specifically, each of the throttle channels 25 has a first vertical part 26 formed in the plate 11*b*, a horizontal part 27 formed in the plate 11*c* and a second vertical part 28 formed in the plate 11*d*. The first vertical part 26 extends downward from an end part, of the pressure chamber 23, on a side opposite to the descender channel 24 in the arrangement direction. The horizontal part 27 extends in the arrangement direction. An end part in the arrangement direction of the horizontal part 27 is connected to the first vertical part 26. The second vertical part 28 extends downward from an end part on the other side in the arrangement direction of the horizontal part 27, and is connected to one of the recovery channels 31 and 32 or to the supply channel 33.

In the present embodiment, the cross-sectional areas of the respective channel parts of the upstream-side throttle channel 25*a* are same as the cross-sectional areas of the respective channel parts of the downstream-side throttle channel 25*b*, respectively. On the other hand, a channel length of the horizontal part 27 of the downstream-side throttle channel 25*b* is shorter than a channel length of the horizontal part 27 of the upstream-side throttle channel 25*a*. Thus, the length of the downstream-side throttle channel 25*b* is shorter than the length of the upstream-side throttle channel 25*a*. As a result, the channel resistance of the downstream-side throttle channel 25*b* is smaller than the channel resistance of the upstream-side throttle channel 25*a*. In the present embodiment, the channel resistance of the downstream-side throttle channel 25*b* is set to be in a range of not less than 60% to not more than 90% of the channel resistance of the upstream-side throttle channel 25*a*.

Next, an explanation will be given about a flow of the ink in a case that the circulation pump 7*p* is driven. Bold arrows in FIG. 2 and arrows in FIG. 3 indicate flow of the ink.

As depicted in FIG. 2, in a case that the circulation pump 7*p* is driven by the control of the controller 5, the ink inside the ink tank 7 is allowed to flow from the inflow port 33*x* to the supply channel 33. Further, the ink is supplied from the supply channel 33 to each of the individual channels 20 (the first individual channels 20*a* and second individual channels 20*b*).

The ink supplied to each of the individual channels 20 passes through the upstream-side throttle channel 25*a* and the upstream-side pressure chamber 23, moving substantially horizontally, further passes through the upstream-side descender channel 24 and moves downwardly, and flows into the communicating path 22. This ink passes through the communicating path 22, and moves horizontally; a part of the ink is discharged from the nozzle 21, and a remainder of the ink passes the downstream-side descender channel 24*b* and moves upwardly, passes the downstream-side pressure chamber 23*b* and the downstream-side throttle channel 25*b*, moving substantially horizontally.

Then, the ink supplied to each of the first individual channels 20*a* is recovered by the recovery channel 31. This ink flows out from the recovery channel 31 via the outflow port 31*y*, and is returned to the ink tank 7. The ink supplied to each of the second individual channels 20*b* is recovered by the recovery channel 32. This ink flows out from the recovery channel 32 via the outflow port 32*y*, and is returned to the ink tank 7.

The ink is circulated between the head 1 and the ink tank 7, as described above. As a result, any increase in the viscosity of the ink inside the nozzle 21 is suppressed. Note that in the present embodiment, the circulation of the ink between the head 1 and the ink tank 7 is always performed. Namely, the circulation of the ink is performed even when the recording processing is being executed.

Note that tin the present embodiment, an end part, of the upstream-side throttle channel 25*a*, to which the supply channel 33 is connected is an inlet of the individual channel 20; an end part, of the downstream-side throttle channel 25*b*, to which the recovery channel 31 or 32 is connected is an outlet of the individual channel 20. The supply channel 33 is connected to the inlet of the individual channel 20, and supplies the ink to the individual channel 20. Each of the recovery channel 31 and 32 is connected to the outlet of the individual channel 20, and recovers the ink from the individual channel 20. Note further that the upstream-side pressure chamber 23*a* is arranged between the inlet and the nozzle 21, and the downstream-side pressure chamber 23*b* is arranged between the outlet and the nozzle 21. The upstream-side throttle channel 25*a* connects the inlet to the upstream-side pressure chamber 23*a*, and the downstream-side throttle channel 25*b* connects the outlet to the downstream-side pressure chamber 23*b*.

The actuator unit 12 is arranged on the upper surface (surface including the channel substrate 11) of the channel substrate 11, and covers the plurality of pressure chambers 23.

As depicted in FIG. 3, the actuator unit 12 includes a vibration plate 12*a*, a common electrode 12*b*, a plurality of piezoelectric bodies 12*c* and a plurality of individual electrodes 12*a*, from a lower part in this order. The vibration plate 12*a* and the common electrode 12*b* are arranged substantially on the entirety of the upper surface of the channel substrate 11, and cover the plurality of pressure chambers 23. On the other hand, each of the plurality of piezoelectric bodies 12*c* and each of the plurality of individual electrodes 12*d* are provided on one of the plurality of pressure chambers 23, and face (are opposite to) one of the pressure chambers 23. The common electrode 12*b* is connected to the driver IC 1*d*, and is always maintained at the ground potential.

In the above-described configuration, one piece of an actuator 13 (see FIG. 3) is constructed of one piece of the individual electrode 12*a*, a part, of the common electrode 12*b*, facing one piece of the pressure chamber 23*a*, and a part, of the piezoelectric body 12*c*, facing one piece of the pressure chamber 23. In the actuator unit 12, such an actuator 13 is formed for each of the pressure chambers 23.

The driver IC 1*d* applies a predetermined driving pulse signal P (see FIGS. 5A and 5B) to the individual electrode 12*d* of each of the actuators 13, based on a control signal from the controller 5, thereby switching the potential of the individual electrode 12*d* between the positive potential and the ground potential. The driving pulse signal P is a pulse signal having a predetermined pulse width and a predetermined pulse height (driving voltage V).

In the present embodiment, a so-called pull driving or pull ejection is adopted as the driving system of the actuator 13. Specifically, the individual electrode 12*d* is maintained at the positive potential in advance. In this situation, difference in the potential is generated between the individual electrode 12*d* and the common electrode 12*b* which is maintained at the ground potential, and the piezoelectric body 12*c* sandwiched between the individual electrode 12*d* and the common electrode 12*b* is piezoelectrically deformed. With this, since the vibration plate 12*a* and the piezoelectric body 12*c* are warped to project toward the side of the pressure chamber 23, there is provided a stand-by state in which the volume of the pressure chamber 23 is reduced.

Afterwards, the driving pulse signal P is applied to the individual electrode 12*d* and the potential of the individual electrode 12*d* thereby becomes the ground potential, and thus the piezoelectric deformation of the piezoelectric body 12*c* is cancelled once. With this, the vibration plate 12*a* and the piezoelectric body 12*c* are allowed to have a flat state without any warping, which in turn increase the volume inside the pressure chamber 23, as compared with the stand-state provided previously. Accompanying with this, in a case of the upstream-side pressure chamber 23*a*, the ink is supplied thereinto from the supply channel 33 via the upstream-side throttle channel 25*a*. Further, in a case of the downstream-side pressure chamber 23*b*, the ink is supplied thereinto from the supply channel 31 or 33 via the downstream-side throttle channel 25*b*.

Then, the potential of the individual channel 12*d* is made the positive potential again, and the volume of the pressure chamber 23 is thereby reduced. In this situation, the pressure is applied to the ink inside the pressure chamber 23.

Figure 5A:
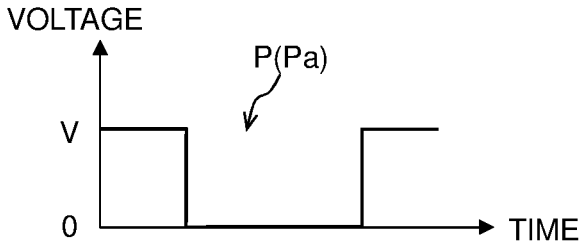
Figure 5B:
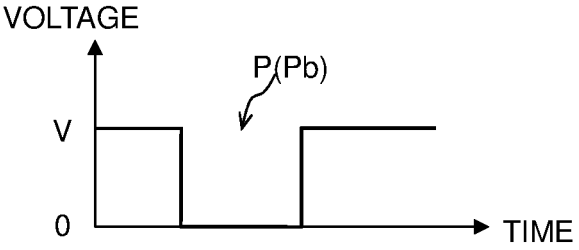

Here, in the present embodiment, a pulse width of a driving pulse signal P (hereinafter referred to as a "driving pulse signal Pa") applied with respect to the individual electrode 12*d* of an actuator 13 corresponding to the upstream-side pressure chamber 23*a* (hereinafter referred to as an "upstream-side actuator 13*a*") and a pulse width of a driving pulse signal P (hereinafter referred to as a "driving pulse signal Pb") applied with respect to the individual electrode 12*d* of an actuator 13 corresponding to the downstream-side pressure chamber 23*b* (hereinafter referred to as an "downstream-side actuator 13*b*") are different from each other, as depicted in FIGS. 5A and 5B. A detailed explanation will be given as follows. Note that a pulse height of the driving pulse signal Pa and a pulse height of the driving pulse signal Pb are same as each other. Namely, a driving voltage by which the driver IC 1*d* drives the upstream-side actuator 13*a* and a driving voltage by which the driver IC 1*d* drives the downstream-side actuator 13*b* are same as each other.

In a case that the potential of the individual electrode 12*d* of the upstream-side actuator 13*a* is changed from the positive potential to the ground potential, and that the volume inside the upstream-side pressure chamber 23*a* is increased, a negative pressure wave is generated in the inside of the upstream-side pressure chamber 23*a*. The negative pressure wave generated in the inside of the upstream-side pressure chamber 23*a* is reversely reflected to the positive pressure in the vicinity of a connecting position at which the upstream-side pressure chamber 23*a* is connected to the supply channel 33, and advances toward the side of the upstream-side pressure chamber 23*a* (toward the side of the nozzle 21). Further, in a case that the potential of the individual electrode 12*d* is returned to the positive potential, a positive pressure wave is generated in the inside of the upstream-side pressure chamber 23*a*. The pulse width of the driving pulse signal Pa is set so that the positive pressure wave which is reversed in the vicinity of the connecting position, of the upstream-side pressure chamber 23*a*, with respect to the supply channel 33 and the positive pressure wave which is provided in a case that the potential of the individual electrode 12*d* is returned to the positive potential are overlapped with each other and are advanced toward the nozzle 21. In other words, the pulse width of the driving pulse signal Pa is set depending on a propagation time until a pressure wave of which medium is the ink reaches the nozzle 21 from the connecting position with respect to the supply channel 33 (hereinafter referred to as an "upstream-side propagation time"). Namely, the pulse width of the driving pulse signal Pa is set so that as the upstream-side propagation time is longer, the pulse width of the driving pulse signal Pa also becomes longer. With this, it is possible to move (feed) the ink toward the nozzle 21 by a larger pressure.

Similarly, a negative pressure wave, which is generated in the inside of the downstream-side pressure chamber 23*b* in a case that the potential of the individual electrode 12*d* of the downstream-side actuator 13*b* becomes the ground potential, is reversely reflected to the positive pressure in the vicinity of a connecting position at which the downstream-side pressure chamber 23*b* is connected to the recovery channel 31 or 32, and advances toward the side of the downstream-side pressure chamber 23*b* (toward the side of the nozzle 21). The pulse width of the driving pulse signal Pb is set so that the positive pressure wave which is reversed in the vicinity of the connecting position, of the downstream-side pressure chamber 23*b*, with respect to the recovery channel 31 or 32 and the positive pressure wave which is provided in a case that the potential of the individual electrode 12*d* is returned to the positive potential are overlapped with each other and are advanced toward the nozzle 21. In other words, the pulse width of the driving pulse signal Pb is set depending on a propagation time until a pressure wave of which medium is the ink reaches the nozzle 21 from the connecting position with respect to the recovery channel 31 or 32 (hereinafter referred to as a "downstream-side propagation time").

As described above, the length of the downstream-side throttle channel 25*b* is shorter than the length of the upstream-side throttle channel 25*a*. Accordingly, the length of a channel from the connecting position with respect to the recovery channel 31 or 32 to the nozzle 21 is shorter than the length of a channel from the connecting position with respect to the supply channel 33 to the nozzle 21. Therefore, the downstream-side propagation time is shorter than the upstream-side propagation time. Accordingly, the pulse width of the driving pulse signal Pb is set to be shorter than the pulse width of the driving pulse signal Pa.

Next, an explanation will be given about a method of driving the upstream-side actuator 13*a* and the downstream-side actuator 13*b* in a case of discharging the ink from the nozzle 21. The controller 5 drives the upstream-side actuator 13*a* and the downstream-side actuator 13*b* which face two pressure chambers 23, respectively, in each of the individual channels 20 to thereby cause the ink to be discharged from the nozzle 21.

Specifically, in a case that the controller 5 causes the ink to be discharged from the nozzle 21, the controller 5 controls the driver IC 1*d* so as to apply the driving pulse signal Pa to the individual electrode 12*d* of the upstream-side actuator 13*a* to thereby drive the upstream-side actuator 13*a*, and so as to apply the driving pulse signal Pb to the individual electrode 12*d* of the downstream-side actuator 13*b* to thereby drive the downstream-side actuator 13*b*.

Here, as described above, the pulse width of the driving pulse signal Pb is shorter than the pulse width of the driving pulse signal Pa. Accordingly, in the case that the controller 5 causes the ink to be discharged from the nozzle 21 and that the controller 5 controls the driver IC 1*d* so that the upstream-side actuator 13*a* and the downstream-side actuator 13*b* are driven at the same time, the discharge direction of the ink discharged from the nozzle 21 is not the vertical direction (immediately below) and is deviated greatly from the vertical direction.

Figure 5C:
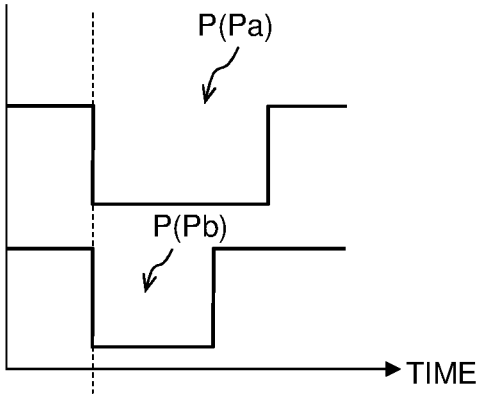

More specifically, in a case that the upstream-side actuator 13*a* and the downstream-side actuator 13*b* are driven at the same time, a start time of the waveform of the driving pulse signal Pa and a start time of the waveform of the driving pulse signal Pb are consequently coincident, as depicted in FIG. 5C. However, as described above, since the pulse width of the driving pulse signal Pb is shorter than the pulse width of the driving pulse signal Pa, as described above, an end time of the waveform of the driving pulse signal Pb is earlier than an end time of the waveform of the driving pulse signal Pa. Namely, a timing at which the potential of the individual electrode 12*d* returns to the positive potential is earlier in the downstream-side actuator 13*b* than that in the upstream-side actuator 13*a*.

Namely, a timing at which the pressure is applied to the ink inside the downstream-side pressure chamber 23*b* is earlier than a timing at which the pressure is applied to the ink inside the downstream-side pressure chamber 23*b*. As a result, a timing at which the pressure wave generated in the downstream-side pressure chamber 23*b* arrives at the nozzle 21 is earlier than a timing at which the pressure wave generated in the upstream-side pressure chamber 23*a* arrives at the nozzle 21. With this, since the timings at which the pressure waves generated in the upstream-side pressure chamber 23*a* and the downstream-side pressure chamber 23*b*, respectively, arrive at the nozzle 21 are shifted from each other, the discharge direction of the ink is consequently greatly deviated from the vertical direction.

Figure 5D:
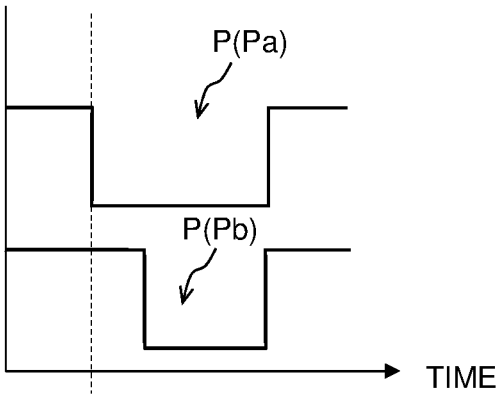

In view of this situation, in the present embodiment, in the case that the controller 5 causes the ink to be discharged from the nozzle 21, the controller 5 controls the driver IC 1*d* so as to delay a driving timing of the downstream-side actuator 13*b* from a driving timing of the upstream-side actuator 13*a* so that the timings at which the pressure waves generated in the upstream-side and downstream-side pressure chambers 23*a* and 23*b*, respectively, arrive at the nozzle 21 are substantially same, as depicted in FIG. 5D. With this, the discharge direction of the ink discharged from the nozzle 21 can be made the vertical direction.

In this situation, even when the recording processing is being executed, the circulation pump 7*p* is driven so as to circulate the ink between the head 1 and the ink tank 7, as described above. Accordingly, during the execution of the recording processing, the ink is allowed to flow form the supply channel 33 toward the recovery channels 31 and 32, via the individual channels 20. On the other hand, in a case that the upstream-side actuator 13 and the downstream-side actuator 13*b* are driven in order to cause the ink to be discharged from the nozzle 21 in the recording processing, the supply of the ink from the supply channel 33 to the upstream-side pressure chamber 23*a* via the upstream-side throttle channel 25*a*, and the supply of the ink from each of the recovery channels 31 and 32 to the downstream-side pressure chamber 23*b* via the downstream-side throttle channel 25*b* are performed, as described above. In this situation, any shortage in the supply of the ink from the supply channel 33 to the upstream-side pressure chamber 23*a*, which is in the same direction as the direction of the flow of the ink by the above-described ink circulation, hardly occurs. On the other hand, any shortage in the supply of the ink from each of the recovery channel 31 and 32 to the downstream-side pressure chamber 23*b*, which is in the opposite or reverse direction to the direction of the flow of the ink by the above-described ink circulation, easily occurs. Accordingly, in a case that any large pressure is applied by the circulation pump 7*p* during the circulation of the ink between the head 1 and the ink tank 7, any shortage in the supply of the ink to the downstream-side pressure chamber 23*b* occurs, which in turn makes the discharge of the ink from the nozzle 21 to be unstable.

In view of this, in the present embodiment, the channel resistance of the downstream-side throttle channel 25*b* is made smaller than the channel resistance of the upstream-side throttle channel 25*a*. By doing so, even in such a case that there is the flow of the ink from the supply channel 33 to each of the recovery channels 31, 32 due to the circulation of the ink, the channel resistance in the downstream-side throttle channel 25*b* is small; thus, it is possible to stably supply the ink from each of the recovery channels 31 and 32 to the downstream-side pressure chamber 23*b*. As a result, it is possible to make the difference between the supply amount of the ink to the upstream-side pressure chamber 23*b* and the supply amount of the ink to the downstream-side pressure chamber 23*b* to be small, thereby making it possible to cause the ink to be discharged stably from the nozzle 21.

Further, in a case that the two pressure chambers 23 that are the upstream-side pressure chamber 23*a* and the downstream-side pressure chamber 23*b* in a limited space in the head 1, and that the shape (volume) of the upstream-side pressure chamber 23*a* and the shape (volume) of the downstream-side pressure chamber 23*b* are made to be same as each other as in the present embodiment, it is possible to make a discharging efficiency in a case of discharging the ink to be high, as compared with such a case that the shape of the upstream-side pressure chamber 23*a* and the shape of the downstream-side pressure chamber 23*b* are different from each other. A detailed explanation regarding this will be given as follows. Note that in the following explanation, it is provided that the total values of the volumes of the two pressure chambers 23 that are the upstream-side pressure chamber 23*a* and the downstream-side pressure chamber 23*b* are mutually same between a case that the shape of the upstream-side pressure chamber 23*a* and the shape the downstream-side pressure chamber 23*b* are same as each other and another case that the shape of the upstream-side pressure chamber 23*a* and the shape of the downstream-side pressure chamber 23*b* are different from each other.

Figure 6:
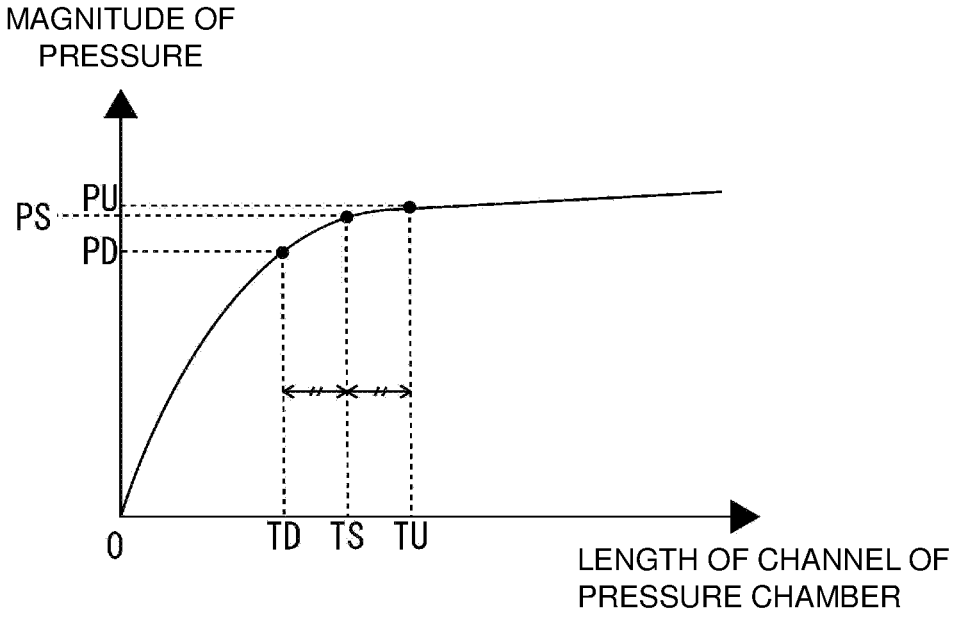
FIG. 6 is a view depicting the relationship between the length of a channel of a pressure chamber and a magnitude of a pressure applied to the pressure chamber.

As depicted in FIG. 6, a magnitude of the pressure applied to the ink inside the pressure chamber 23, in a case that the actuator 13 is driven by applying a certain driving pulse signal P, becomes greater as the length of the channel (channel length) of the pressure chamber 23 is longer provided that the cross-sectional area of the channel (channel cross-sectional area) of the pressure chamber 23 is same. On the other hand, in a case that the channel length of the pressure chamber 23 is greater than a predetermined length TS, the magnitude of the pressure applied to the ink inside the pressure chamber 23 is hardly different from a pressure value PS in a case that the channel length is the channel length TS. Namely, the magnitude of the pressure applied to the ink inside the pressure chamber 23 does not increase linearly accompanying with the increase in the channel length of the pressure chamber 23; rather, the magnitude of the pressure applied to the ink inside the pressure chamber 23 represents a curve saturating in the vicinity of the pressure value PS.

In the present embodiment, the lengths of the two pressure chambers 23 that are the upstream-side pressure chamber 23*a* and the downstream-side pressure chamber 23*b* are both set to be the length TS. Accordingly, the magnitudes of the pressures applied to the ink inside the upstream-side pressure chamber 23*a* and the downstream-side pressure chamber 23*b*, respectively, are each the pressure value PS.

In this situation, in order to make the shapes of the two pressure chambers 23 to be different from each other in a state that the total value of the volumes of these two pressure chambers 23 is maintained (in a state that the total value of the channel lengths of these two pressure chambers 23 is maintained), it is necessary to make the channel length of one pressure chamber 23 of the two pressure chambers 23 to be a length TD shorter than the length TS, and to make the channel length of the other pressure chamber 23 of the two pressure chambers 23 to be a length TU longer than the length TS. In this situation, the magnitude of the pressure applied to the ink inside the pressure chamber 23 of which channel length is the length TD becomes a pressure value PD smaller than the pressure value PS; whereas the magnitude of the pressure applied to the ink inside the pressure chamber 23 of which channel length is the length TU becomes a pressure value PU greater than the pressure value PS.

As described above, in the case that the channel length of the pressure chamber 23 exceeds the length TS, the magnitude of the pressure applied to the ink inside the pressure chamber 23 hardly changes even if the channel length of the pressure chamber 23 is changed. Accordingly, an extent of increase from the pressure value PS to the pressure value PU is smaller than an extent of decrease from the pressure value PS to the pressure value PD. Namely, the total value of the pressure value PD and the pressure value PU becomes smaller than twice the pressure value PS.

As explained above, the total value of the pressures applied to the ink inside the two pressure chambers 23 becomes greater in the case wherein the channel lengths of the two pressure chambers 23 are both made the length TS so that the shapes of the two pressure chambers 23 are same as each other, than in the case wherein the shapes of the two pressure chambers 23 are different from each other. As a result, the discharge energy of the ink discharged from the nozzle 21 becomes great and the discharge efficiency becomes high in the case wherein the volumes (shapes) of the two pressure chambers 23 are allowed to be same.

Note that in a case that the channel lengths of the two pressure chambers 23 can be both made to be not less than the length TS as depicted in FIG. 6, then even in a case that the channel lengths of the two pressure chambers 23 are different from each other, it is possible to increase the discharge efficiency, similarly to the case wherein the shapes of the two pressure chambers 23 are made the same. However, it is difficult to allow both the channel length of the upstream-side pressure chamber 23*a* and the channel length of the downstream-side pressure chamber 23*b* to be not less than the length TS in a limited space of the head 1.

Therefore, as in the present embodiment, by allowing the shape of the upstream-side pressure chamber 23*a* and the shape of the downstream-side pressure chamber 23*b* to be same as each other, it is possible to increase the discharge efficiency, while arranging the upstream-side pressure chamber 23*a* and the downstream-side pressure chamber 23*b* in the limited space of the head 1.

Note that the phrase "a (the) shape of the upstream-side pressure chamber 23*a* and a (the) shape of the downstream-side pressure chamber 23*b* are same as each other" also encompasses such a case that the shape of the upstream-side pressure chamber 23*a* and the shape of the downstream-side pressure chamber 23*b* are not completely same but a substantially same to such an extent that the discharge efficiency becomes to be not less than a predetermined threshold value, in addition to a case that the shapes are completely same.

Note also that in the present embodiment, in a case that the controller 5 causes the ink to be discharged from the nozzle 21, the controller 5 controls the driver IC 1*d* so that the driving timing of the upstream-side actuator 13*a* and the driving timing of the downstream-side actuator 13*b* are different from each other. Since the driving timing of the upstream-side actuator 13*a* and the driving timing of the downstream-side actuator 13*b* are shifted from each other in such a manner, it is possible to suppress the heating of the driver IC 1*d*, as compared in a case that the driving timing of the upstream-side actuator 13*a* and the driving timing of the downstream-side actuator 13*b* are same. A detailed explanation for this will be given as follows.

An electric current flows in the driver IC 1*d* in a case of driving the actuator 13. In particular, a large electric current flows in the driver IC 1*d* in a case of switching the potential of the individual electrode 12*d* of the actuator 13 between the positive potential and the ground potential. Namely, the large electric current flows in the driver IC 1*d* at the start time and at the end time of the waveform the driving pulse signal P. Further, in a case that the driving timing of the upstream-side actuator 13*a* and the driving timing of the downstream-side actuator 13*b* are same as each other, the start time of the waveform of the driving pulse signal Pa and the start time of the waveform of the driving pulse signal Pb are coincident, and thus an excessive or very large electric current flows in the driver IC 1*d* in a concentrated manner. On the other hand, in a case that the driving timing of the upstream-side actuator 13*a* and the driving timing of the downstream-side actuator 13*b* are shifted from each other, the start time of the waveform of the driving pulse signal Pa and the start time of the waveform of the driving pulse signal Pb are consequently shifted from each other. Accordingly, any excessive electric currently does not flow in the driver IC 1*d*. Accordingly, by shifting the driving timing of the upstream-side actuator 13*a* and the driving timing of the downstream-side actuator 13 from each other as in the present embodiment, it is possible to suppress such a situation that any excessive electric current flows in the driver IC 1*d*, which results in suppressing the heating of the driver IC 1*d*. Note that in view of suppressing the heating of the driver IC 1*d*, it is preferred that the driving timing of the upstream-side actuator 13*a* and the driving timing of the downstream-side actuator 13*b* are shifted from each other so that not only that the start times of the waveforms of the driving pulse signals Pa and Pb, respectively, are shifted from each other, but also that the end times of the waveforms of the driving pulse signals Pa and Pb, respectively, are shifted from each other.

Furthermore, in a case that the controller 5 causes the ink to be discharged from the nozzle 21, the controller 5 controls the driver IC 1*d* so that the driving timing of the downstream-side actuator 13*b* to be delayed (later) than the driving timing of the upstream-side actuator 13*a*. As a result, the discharge direction of the ink discharged from the nozzle 21 can be made to the vertical direction.

Moreover, the channel resistance of the downstream-side throttle channel 25*b* is set to be in a range of not less than 60% to not more than 90% of the channel resistance of the upstream-side throttle channel 25*a*. With this, it is possible to supply the ink stably to the downstream-side pressure chamber 23*b*, while maintaining the above-described throttling function of the downstream-side throttle channel 25*b*.

Here, in such a case that the channel resistance of the downstream-side throttle channel 25*b* is greater than 90% of the channel resistance of the upstream-side throttle channel 25*a*, the difference between the pulse width of the driving pulse signal Pa and the pulse width of the driving pulse signal Pb becomes to be small. As a result, even when the upstream-side actuator 13*a* and the downstream-side actuator 13*b* are driven at the same time, the discharging direction of the ink discharged from the nozzle 21 is not largely deviated from the vertical direction. Namely, in a case that the controller 5 controls the driver IC 1*d* so that the driving timing of the downstream-side actuator 13*b* to be delayed from the driving timing of the upstream-side actuator 13*a*, there is such a possibility that the discharging direction of the ink discharged from the nozzle 21 is rather largely deviated from the vertical direction, as compared with the case that the controller 5 controls the driver IC 1*d* so that the driving timing of the downstream-side actuator 13*b* to be same with the driving timing of the upstream-side actuator 13*a*. Accordingly, in a case that the channel resistance of the downstream-side throttle channel 25*b* is greater than 90% of the channel resistance of the upstream-side throttle channel 25*a*, it is not possible to shift the driving timing of the upstream-side actuator 13*a* and the driving timing of the downstream-side actuator 13*b* from each other, which in turn leads to such a possibility that the heating of the driving IC 1*d* might not be suppressed.

On the other hand, in a case that the channel resistance of the downstream-side throttle channel 25*b* is not more than 90% of the channel resistance of the upstream-side throttle channel 25*a*, it is necessary to shift the driving timing of the upstream-side actuator 13*a* and the driving timing of the downstream-side actuator 13*b* from each other in order to make the discharging direction of the ink discharged from the nozzle 21 to be the vertical direction. In other words, it is possible to shift the driving timing of the upstream-side actuator 13*a* and the driving timings of the downstream-side actuator 13*b* from each other, in a state that the discharging direction of the ink is maintained at the vertical direction. Due to this configuration, it is possible to suppress the heating of the driver IC 1*d* assuredly.

Further, in the present embodiment, the channel resistance of the downstream-side throttle channel 25*b* is adjusted to be smaller than the channel resistance of the upstream-side throttle channel 25*a*, by making the length of the downstream-side throttle channel 25*b* to be shorter than the length of the upstream-side throttle channel 25*a*. Here, as a method of adjusting the channel resistance of the upstream-side throttle channel 25*a* and the channel resistance of the downstream-side throttle channel 25*b*, there are a variety of methods, other than the method of changing the channel length(s), as in the present embodiment. For example, it is also possible to adjust the channel resistance of the downstream-side throttle channel 25*b* to be smaller than the channel resistance of the upstream-side throttle channel 25*a*, by making the channel cross-sectional area of the downstream-side throttle channel 25*b* to be greater than the channel cross-sectional area of the upstream-side throttle channel 25*a*. However, in view of the characteristic of etching, the adjustment accuracy of the channel resistance is higher in the case of changing the channel length than in a case of changing the channel cross-sectional area. A detailed explanation for this will be given as follows.

In a case of performing the etching for a plate, a part or portion in the vicinity of the boundary of the etching usually has a gentle slope, without being processed at an acute angle. Due to this, in a case of performing, for example, the etching so that an etching width in the extending direction of the upstream-side throttle channel 25*a* at the horizontal part 27 and an etching width in the extending direction of the downstream-side throttle channel 25*b* at the horizontal part 27 are different from each other, the shape of the channel cross-section at the horizontal part 27 of the upstream-side throttle channel 25*a* and the shape of the channel cross-section at the horizontal part 27 of the downstream-side throttle channel 25*b* do not become similar to each other, due to the gentle slope occurring in the vicinity of the boundary of the etching. Namely, in a case of making the ratio between the channel resistance of the upstream-side throttle channel 25*a* and the channel resistance of the downstream-side throttle channel 25*b* to be a desired value, it is necessary to consider the gentle curve occurring in the vicinity of the boundary of the etching, in addition to the etching width in the extending direction of the horizontal part 27.

On the other hand, in a case of the method of adjusting the channel resistance(s) by changing the length of the upstream-side throttle channel 25*a* and the length of the downstream-side throttle channels 25*b*, the channel cross-sectional area of the upstream-side throttle channel 25*a* and the channel cross-sectional area of the downstream-side throttle channels 25*b* are same as each other. Accordingly, in the case of making the ratio between the channel resistance of the upstream-side throttle channel 25*a* and the channel resistance of the downstream-side throttle channel 25*b* to be a desired value, there is no need to consider the gentle curve occurring in the vicinity of the boundary of the etching.

For the above-described reason, in the case of the method of adjusting the channel resistance(s) by making the length of the downstream-side throttle channel 25*b* to be shorter than the length of the upstream-side throttle channel 25*a*, as in the present embodiment, it is possible to increase the adjustment accuracy.

Further, in the present embodiment, the driving voltage in a case that the driver IC 1*d* drives the upstream-side actuator 13*a* and the driving voltage in a case that the driver IC 1*d* drives the downstream-side actuator 13*b* are same as each other. Accordingly, it is possible to simplify the driving control, by the driver IC 1*d*, of the upstream-side actuator 13*a* and the downstream-side actuator 13*b*, as compared with a case wherein the driving voltages are different from each other. As a result, it is possible to make the size of the driver IC 1*d* to be small and/or to lower the cost.

Second Embodiment

Next, a second embodiment of the present disclosure will be explained. The second embodiment is different from the first embodiment mainly in that the shape of the upstream-side pressure chamber and the shape of the downstream-side pressure chamber are different from each other in the head. In the following, a part, element or component of which configuration is similar to that in the first embodiment is assigned with a same or similar reference numeral as that in the first embodiment, and an explanation therefor will be appropriately omitted.

Figure 7:
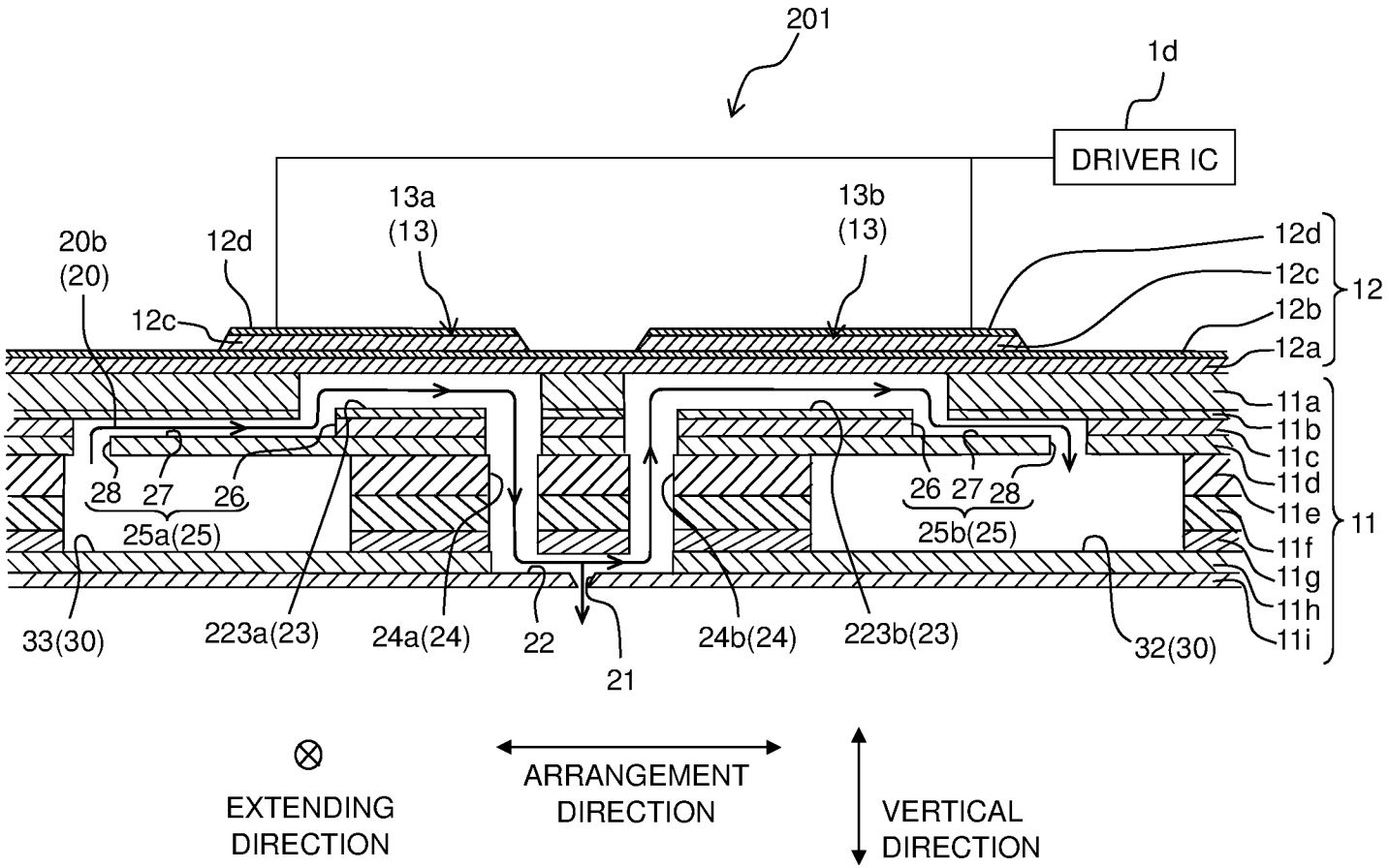
FIG. 7 is a cross-sectional view of a head according to a second embodiment (view depicting the second embodiment, corresponding to FIG. 3).

As depicted in FIG. 7, in a head 201 according to the second embodiment, the volume of an upstream-side pressure chamber 223*a* is smaller than the volume of a downstream-side pressure chamber 223*b*. More specifically, although the length in the extending direction of the upstream-side pressure chamber 223*a* and the length in the extending direction of the downstream-side pressure chamber 223*b* are same as each other, the length in the arrangement direction of the upstream-side pressure chamber 223*a* is shorter than the length in the arrangement direction of the downstream-side pressure chamber 223*b*. Accordingly, the channel resistance of the upstream-side pressure chamber 223*a* is smaller than the channel resistance of the downstream-side pressure chamber 223*b*.

Figure 8A:
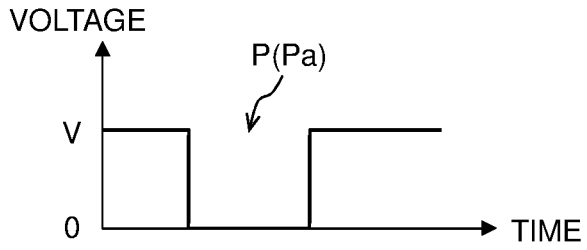
FIGS. 8A to 8C are views each depicting a driving pulse signal in the second embodiment, and correspond to FIGS. 5A to 5C, respectively.
Figure 8B:
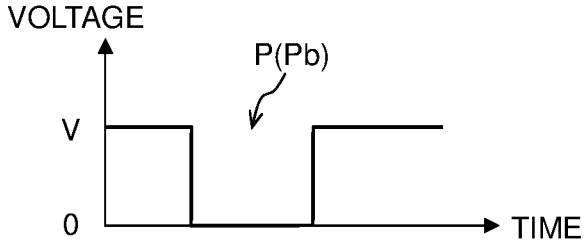

Here, in the second embodiment, since the channel length of the upstream-side pressure chamber 223*a* is shorter than the channel length of the downstream-side pressure chamber 223*b*, a propagation time during which a pressure wave of which medium is the ink propagates in the upstream-side pressure chamber 223*a* becomes shorter than a propagation time during which a pressure wave of which medium is the ink propagates in the downstream-side pressure chamber 223*b*. In the second embodiment, the channel length of the upstream-side pressure chamber 223*a* and the channel length of the downstream-side pressure chamber 223*b* are adjusted to thereby perform a setting so that difference between an upstream-side propagation time until a pressure wave of which medium is the ink reaches the nozzle 21 from a connecting position with respect to the supply channel 33 and a downstream-side propagation time until a pressure wave of which medium is the ink reaches the nozzle 21 from a connecting position with respect to the recovery channel 31 or 32 becomes to be not more than a predetermined threshold value. Accordingly, as depicted in FIGS. 8A and 8B, there is little difference between the pulse width of the driving pulse signal Pa and the pulse width of the driving pulse signal Pb. Therefore, in a case of causing the ink to be discharged from the nozzle 21, even in a case that the upstream-side actuator 13*a* and the downstream-side actuator 13*b* are driven at the same time, it is possible to make the discharging direction of the ink to be the vertical direction.

Figure 8C:
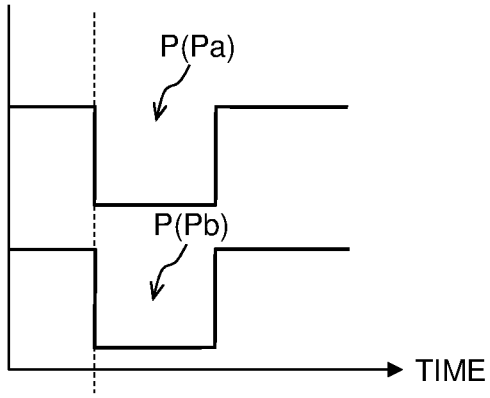

In view of this, in the second embodiment, the controller 5 controls the driver IC 1*d* so that in a case of causing the ink to be discharged from the nozzle 21, the upstream-side actuator 13*a* and the downstream-side actuator 13*b* are driven at the same time. Namely, the controller 5 controls the driver IC 1*d* so that the start time of the waveform of the driving pulse signal Pa is coincident with the start time of the waveform of the driving pulse signal Pb, as depicted in FIG. 8C. In such a manner, the second embodiment is capable of making the driving timing of the upstream-side actuator 13*a* to be same as the driving timing of the downstream-side actuator 13*b*, and thus the second embodiment is capable of simplifying the control of the driver IC 1*d*, although not capable of suppressing the heating of the driver IC 1*d*.

Further, in the second embodiment, the volume of the upstream-side pressure chamber 223*a* is made smaller than the volume of the downstream-side pressure chamber 223*b*, to thereby make the channel resistance of the upstream-side pressure chamber 223*a* smaller than the channel resistance of the downstream-side pressure chamber 223*b*. In such a manner, in a case of the method of adjusting the channel resistance of the upstream-side pressure chamber 223*a* and the channel resistance of the downstream-side pressure chamber 223*b* by changing the volume of the upstream-side pressure chamber 223*a* and the volume of the downstream-side pressure chamber 223*b*, it is possible to easily adjust the channel resistance of the upstream-side pressure chamber 223*a* and the channel resistance of the downstream-side pressure chamber 223*b*. For example, it is possible to easily adjust the channel resistance of the upstream-side pressure chamber 223*a* and the channel resistance of the downstream-side pressure chamber 223*b*, as compared with such a method of adjusting the length in the arrangement direction and/or the length in the extending direction of each of the upstream-side pressure chamber 223*a* and the downstream-side pressure chamber 223*b*, in a state that the volume of the upstream-side pressure chamber 223*a* and the volume of the downstream-side pressure chamber 223*b* are made to be same as each other, to thereby adjust the channel resistance of the upstream-side pressure chamber 223*a* and the channel resistance of the downstream-side pressure chamber 223*b*. Note that in the second embodiment, since the volume of the upstream-side pressure chamber 223*a* is smaller than the volume of the downstream-side pressure chamber 223*b*, the discharging efficiency is lowered as compared with the above-described first embodiment.

Third Embodiment

Next, a third embodiment of the present disclosure will be explained. The third embodiment is different from the first embodiment mainly in a connecting position at which the upstream-side throttle channel is connected to the upstream-side pressure chamber in the head. In the following, a part, element or component of which configuration is similar to that in the first embodiment is assigned with a same or similar reference numeral as that in the first embodiment, and an explanation therefor will be appropriately omitted.

Figure 9:
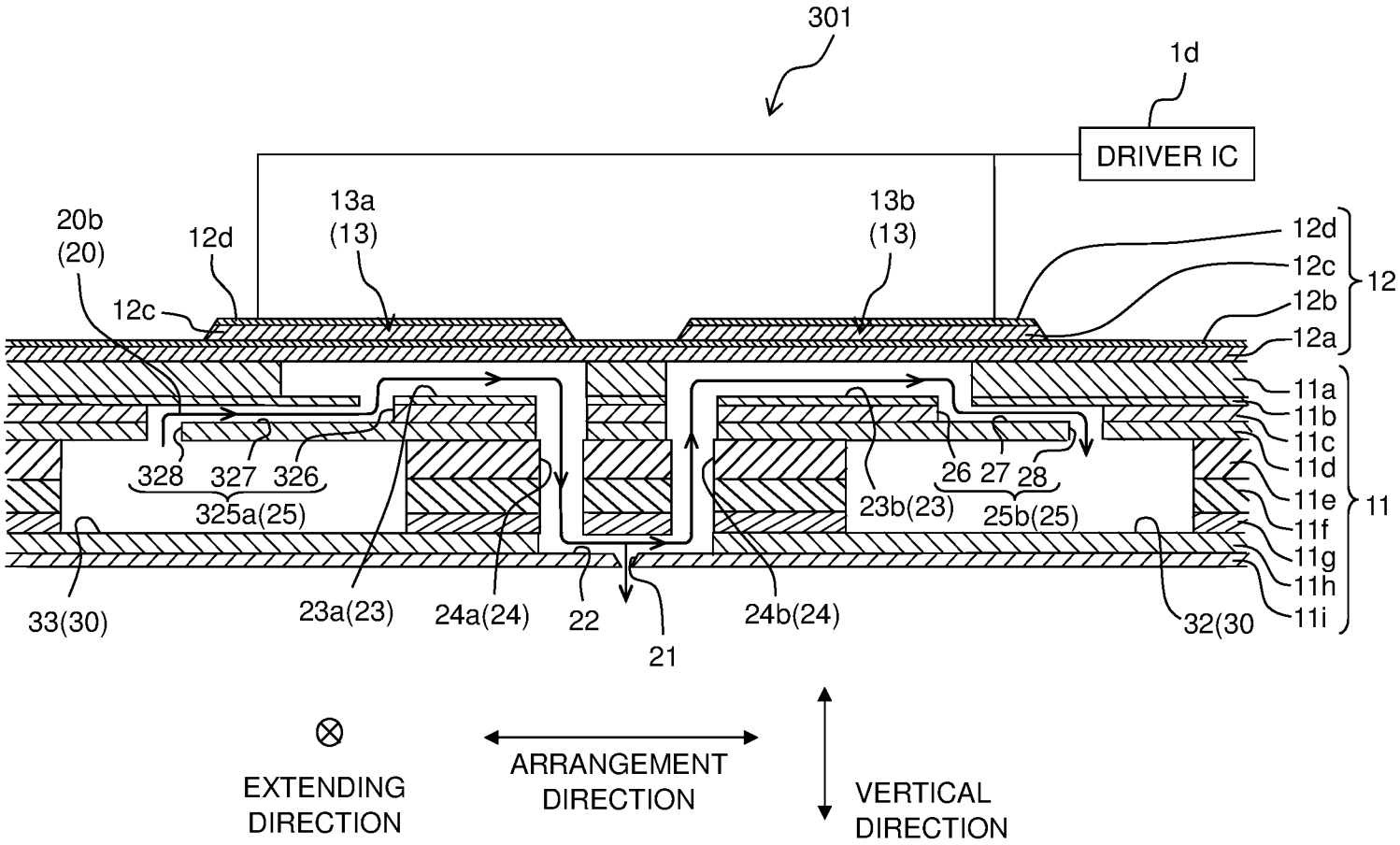
FIG. 9 is a cross-sectional view of a head according to a third embodiment (view depicting the third embodiment, corresponding to FIG. 3).

As depicted in FIG. 9, a head 31 according to the third embodiment is provided with an upstream-side throttle channel 325*a*, rather than the upstream-side throttle channel 25*a* of the first embodiment. The upstream-side throttle channel 325*a* has a first vertical part 326, a horizontal part 327 and a second vertical part 328. The first vertical part 326, the horizontal part 327 and the second vertical part 328 in the upstream-side throttle channel 325*a* have similar constructions, respectively, to those of the first vertical part 26, the horizontal part 27 and the second vertical part 28 in the upstream-side throttle channel 25*a* of the first embodiment, except that the formation positions in the arrangement direction thereof are different from those in the upstream-side throttle channel 25*a*. Accordingly, also in the third embodiment, the channel resistance of the downstream-side throttle channel 325*b* is smaller than the channel resistance of the upstream-side throttle channel 325*a*.

In the third embodiment, the first vertical part 326 of the upstream-side throttle channel 325*a* extends downward from a central part in the arrangement direction of the upstream-side pressure chamber 23, rather than from an end part in the arrangement direction, of the upstream-side pressure chamber 23*a*, on the side opposite to the descender channel 24. Namely, a length of a channel between the connecting position in the upstream-side pressure chamber 23*a* with respect to the upstream-side descender channel 24*a* and the connecting position in the upstream-side pressure chamber 23*a* with respect to the upstream-side throttle channel 325*a* is shorter than a length of a channel between the connecting position in the downstream-side pressure chamber 23*b* with respect to the downstream-side descender channel 24*b* and the connecting position in the downstream-side pressure chamber 23*b* with respect to the downstream-side throttle channel 25*b*. Namely, in the third embodiment, a propagation time until a pressure wave of which medium is the ink propagates between the connecting position with respect to the upstream-side descender channel 24*a* and the connecting position with respect to the upstream-side throttle channel 325*a* in the upstream-side pressure chamber 223*a* is shorter than a propagation time until a pressure wave of which medium is the ink propagates between the connecting position with respect to the downstream-side descender channel 24*b* and the connecting position with respect to the downstream-side throttle channel 25*b* in the downstream-side pressure chamber 23*b*.

In the third embodiment, the connecting position in the upstream-side pressure chamber 23*a* with respect to the upstream-side throttle channel 325*a* is adjusted to thereby perform a setting so that a difference between an upstream-side propagation time until a pressure wave of which medium is the ink reaches the nozzle 21 from a connecting position with respect to the supply channel 33 and a downstream-side propagation time until a pressure wave of which medium is the ink reaches the nozzle 21 from a connecting position with respect to the recovery channel 31 or 32 becomes to be not more than a predetermined threshold value. Accordingly, also in the third embodiment, there is little difference between the pulse width of the driving pulse signal Pa and the pulse width of the driving pulse signal Pb. Therefore, in a case of causing the ink to be discharged from the nozzle 21, even in a case that the upstream-side actuator 13*a* and the downstream-side actuator 13*b* are driven at the same time, it is possible to make the discharging direction of the ink to be the vertical direction.

In view of this, also in the third embodiment, the controller 5 controls the driver IC 1*d* so that in a case of causing the ink to be discharged from the nozzle 21, the upstream-side actuator 13*a* and the downstream-side actuator 13*b* are driven at the same time. In such a manner, the third embodiment is capable of making the driving timing of the upstream-side actuator 13*a* to be same with the driving timing of the downstream-side actuator 13*b*, and thus the third embodiment is capable of simplifying the control of the driver IC 1*d*, although not capable of suppressing the heating of the driver IC 1*d*. Furthermore, in the third embodiment, since the shape of the upstream-side pressure chamber 23*a* and the shape of the downstream-side pressure chamber 23*b* are same as each other, it is possible to increase the discharge efficiency, while arranging the upstream-side pressure chamber 23*a* and the downstream-side pressure chamber 23*b* in the limited space of the head 1, similarly to the first embodiment.

In the foregoing, the embodiments of the present disclosure have been explained. The present disclosure, however, is not limited to or restricted by the above-described embodiments, and a variety of kinds of changes may be made to the present disclosure within the range described in the claims. For example, in the above-described embodiments, the channel resistance of the downstream-side throttle channel is made smaller than the channel resistance of the upstream-side throttle channel by making the length of the downstream-side throttle channel to be shorter than the length of the upstream-side throttle channel. The present disclosure, however, is not limited to this. For example, the channel resistance of the downstream-side throttle channel may be made smaller than the channel resistance of the upstream-side throttle channel by making the channel cross-sectional area of the downstream-side throttle channel to be greater than the channel cross-sectional area of the upstream-side throttle channel.

Further, in the above-described first embodiment, in the case of discharging the ink from the nozzle 21, the controller 5 controls the driver IC 1*d* so that the driving timing of the downstream-side actuator 13*b* is delayed from the driving timing of the upstream-side actuator 13*a*. The present disclosure, however, is not limited to this. For example, in a case that it is not necessary to make the discharging direction of the ink to be the vertical direction, the controller 5 may control the driver IC 1*d* so that the driving timing of the downstream-side actuator 13*b* is earlier than the driving timing of the upstream-side actuator 13*a*. Also in such a case, since the driving timing of the upstream-side actuator and the driving timing of the downstream-side actuator are shifted from each other, it is possible to suppress the heating of the driver IC. Furthermore, for example, in a case that the channel resistance of the downstream-side throttle channel is greater than 90% of the channel resistance of the upstream-side throttle channel, and that the ink is to be discharged from the nozzle 21, the controller 5 may control the driver IC so that the driving timing of the downstream-side actuator 13*b* is made same as the driving timing of the upstream-side actuator 13*a*.

Moreover, in the above-described first and third embodiments, the shape of the upstream-side pressure chamber 23*a* and the shape of the downstream-side pressure chamber 23*a* are same as each other. The present disclosure, however, is not limited to this. For example, it is allowable that although the shape of the upstream-side pressure chamber 23*a* and shape of the downstream-side pressure chamber 23*b* are different from each other, the volume of the upstream-side pressure chamber 23*a* and the volume of the downstream-side pressure chamber 23*b* may be same as each other. In such a case, although the discharging efficiency is lowered as compared with the case wherein the shape of the upstream-side pressure chamber 23*a* and the shape of the downstream-side pressure chamber 23*a* are same as each other, it is possible to increase the discharging efficiency as compared with another case wherein the volume of the upstream-side pressure chamber 23*a* and the volume of the downstream-side pressure chamber 23*a* are different from each other. Note that the phrase "a (the) volume of the upstream-side pressure chamber 23*a* and a (the) volume of the downstream-side pressure chamber 23*b* are same as each other" also encompasses such a case that the volume of the upstream-side pressure chamber 23*a* and the volume of the downstream-side pressure chamber 23*b* are not completely same but are substantially same to such an extent that the discharge efficiency becomes to be not less than a predetermined threshold value, in addition to a case that the volumes are completely same. For example, even in such a case that any error of about 10% between the volume of the upstream-side pressure chamber and the volume of the downstream-side pressure chamber, it is considered that the volume of the upstream-side pressure chamber and the volume of the downstream-side pressure chamber are same as each other. Further, although the discharging efficiency is lowered, it is allowable that the shape of the upstream-side pressure chamber and the shape of the downstream-side pressure chamber are different from each other, and that the volume of the upstream-side pressure chamber and the volume of the downstream-side pressure chamber are different from each other, as well.

Further, it is allowable that the driving voltage in a case that the driver IC drives the upstream-side actuator is different from the driving voltage in a case that the driver IC drives the downstream-side actuator. For example, in the second embodiment, it is allowable to make the driving voltage in a case that the driver IC drives the upstream-side actuator to be higher than the driving voltage in a case that the driver IC drives the downstream-side actuator.

Furthermore, although in the above-described embodiments, the ink is circulated between the head 1 and the ink tank 7, it is allowable that the ink is not circulated provided that the flow of the ink from the supply channel toward the recovery channel(s) via the plurality of individual channels is generated. In such a case, it is preferred that a tank configured to accumulate air in the recovery channels in order to increase recovery efficiency in the recovery of the air flowing out from the individual channels to the recovery channels.

Moreover, in the above-described embodiments, although the driver IC 1*d* drives the actuator 13 by the pull driving or pull ejection system, the present disclosure is not limited to this. Accordingly, it is allowable to drive the actuator by a so-called push driving or push ejection system in which the volume of the pressure chamber is decreased, from a stand-by state, so as to generate a positive pressure wave, thereby causing the ink to be discharged.

Further, in the foregoing, the explanation has been given regarding the example in which the present disclosure is applied to the printer provide with a so-called line head. The present disclosure, however, is not limited to this. The present disclosure is applicable also to a printer provided with a so-called serial head which is mounted on a carriage movable in a scanning direction and which is configured to discharge an ink from the nozzle, while moving in the scanning direction together with the carriage.

Furthermore, in the foregoing, the explanation has been given regarding the example in which the present disclosure is applied to the printer configured to discharge the ink from the nozzles onto a recording paper so as to perform recording on the recording paper. The present disclosure, however, is not limited to this. The present disclosure is also applicable to a liquid discharge head which discharges a liquid different from the ink, such as a liquefied resin, metal, etc.

What is claimed is:

1. A liquid discharge head comprising:

an individual channel having an inlet and an outlet, the individual channel including:

a nozzle, an upstream-side pressure chamber arranged between the inlet and the nozzle, a downstream-side pressure chamber arranged between the outlet and the nozzle, an upstream-side throttle channel connecting the inlet and the upstream-side pressure chamber, and a downstream-side throttle channel connecting the outlet and the downstream-side pressure chamber;

a supply channel connected to the inlet of the individual channel and configured to supply liquid to the individual channel;

a recovery channel connected to the outlet of the individual channel and configured to recover the liquid from the individual channel;

an upstream-side actuator configured to apply pressure to the liquid inside the upstream-side pressure chamber; and a downstream-side actuator configured to apply the pressure to the liquid inside the downstream-side pressure chamber, wherein a channel resistance of the downstream-side throttle channel is smaller than a channel resistance of the upstream-side throttle channel, and a volume of the upstream-side pressure chamber and a volume of the downstream-side pressure chamber are same as each other.

2. The liquid discharge head according to claim 1, wherein a shape of the upstream-side pressure chamber and a shape of the downstream-side pressure chamber are same as each other.

3. The liquid discharge head according to claim 1, wherein the individual channel further has:

an upstream-side connecting channel connecting the upstream-side pressure chamber to the nozzle; and a downstream-side connecting channel connecting the downstream-side pressure chamber to the nozzle, and a length of a channel, in the upstream-side pressure chamber, between a connecting position at which the upstream-side pressure chamber is connected to the upstream-side connecting channel and a connecting position at which the upstream-side pressure chamber is connected to the upstream-side throttle channel is shorter than a length of a channel, in the downstream-side pressure chamber, between a connecting position at which the downstream-side pressure chamber is connected to the downstream-side connecting channel and a connecting position at which the downstream-side pressure chamber is connected to the downstream-side throttle channel.

4. A liquid discharge apparatus comprising:

the liquid discharge head as defined in claim 3 and having a driver configured to drive the upstream-side actuator and the downstream-side actuator; and a controller configured to control the driver so that a driving timing at which the driver drives the upstream-side actuator and a driving timing at which the driver drives the downstream-side actuator are same as each other, in a case that liquid is discharged from the nozzle.

5. The liquid discharge apparatus according to claim 4, wherein the controller is configured to control the driver so that the driver drives the upstream-side actuator and the downstream-side actuator by a same driving voltage.

6. The liquid discharge head according to claim 1, wherein the channel resistance of the downstream-side throttle channel is not less than 60% and not more than 90% of the channel resistance of the upstream-side throttle channel.

7. The liquid discharge head according to claim 1, wherein the downstream-side throttle channel is shorter than the upstream-side throttle channel.

8. The liquid discharge head according to claim 1, further comprising a driver configured to drive the upstream-side actuator and the downstream-side actuator.

9. A liquid discharge apparatus comprising:

the liquid discharge head as defined in claim 1 and having a driver configured to drive the upstream-side actuator and the downstream-side actuator; and a controller configured to control the driver so that a driving timing at which the driver drives the upstream-side actuator is different from a driving timing at which the driver drives the downstream-side actuator, in a case that liquid is discharged from the nozzle.

10. The liquid discharge apparatus according to claim 9, wherein in the case that the liquid is discharged from the nozzle, the controller is configured to control the driver so that the driving timing at which the driver drives the downstream-side actuator is delayed from the driving timing at which the driver drives the upstream-side actuator.

11. The liquid discharge apparatus according to claim 9, wherein the controller is configured to control the driver so that the driver drives the upstream-side actuator and the downstream-side actuator by a same driving voltage.

12. A liquid discharge head comprising:

an individual channel having an inlet and an outlet, the individual channel including:

a nozzle, an upstream-side pressure chamber arranged between the inlet and the nozzle, a downstream-side pressure chamber arranged between the outlet and the nozzle, an upstream-side throttle channel connecting the inlet and the upstream-side pressure chamber, and a downstream-side throttle channel connecting the outlet and the downstream-side pressure chamber;

a supply channel connected to the inlet of the individual channel and configured to supply liquid to the individual channel;

a recovery channel connected to the outlet of the individual channel and configured to recover the liquid from the individual channel;

an upstream-side actuator configured to apply pressure to the liquid inside the upstream-side pressure chamber; and a downstream-side actuator configured to apply the pressure to the liquid inside the downstream-side pressure chamber, wherein a channel resistance of the downstream-side throttle channel is smaller than a channel resistance of the upstream-side throttle channel, and a channel resistance of the upstream-side pressure chamber is smaller than a channel resistance of the downstream-side pressure chamber.

13. The liquid discharge head according to claim 12, wherein a volume of the upstream-side pressure chamber is smaller than a volume of the downstream-side pressure chamber.

14. The liquid discharge head according to claim 12, wherein the channel resistance of the downstream-side throttle channel is not less than 60% and not more than 90% of the channel resistance of the upstream-side throttle channel.

15. The liquid discharge head according to claim 12, wherein the downstream-side throttle channel is shorter than the upstream-side throttle channel.

16. The liquid discharge head according to claim 12, further comprising a driver configured to drive the upstream-side actuator and the downstream-side actuator.

17. A liquid discharge apparatus comprising:

the liquid discharge head as defined in claim 12, and having a driver configured to drive the upstream-side actuator and the downstream-side actuator; and a controller configured to control the driver so that a driving timing at which the driver drives the upstream-side actuator and a driving timing at which the driver drives the downstream-side actuator are same as each other, in a case that liquid is discharged from the nozzle.

18. The liquid discharge apparatus according to claim 17, wherein the controller is configured to control the driver so that the driver drives the upstream-side actuator and the downstream-side actuator by a same driving voltage.

* * * * *